US007616085B2

(12) United States Patent
Ito et al.

(10) Patent No.: US 7,616,085 B2
(45) Date of Patent: Nov. 10, 2009

(54) COMMON MODE CHOKE COIL

(75) Inventors: Tomokazu Ito, Tokyo (JP); Takeshi Okumura, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/128,470

(22) Filed: May 28, 2008

(65) Prior Publication Data

US 2008/0303621 A1 Dec. 11, 2008

(30) Foreign Application Priority Data

Jun. 8, 2007 (JP) ..... 2007-152323

(51) Int. Cl.
*H01F 5/00* (2006.01)

(52) U.S. Cl. ..... 336/200

(58) Field of Classification Search ..... 336/65, 336/83, 200, 232–234
See application file for complete search history.

(56) References Cited

U.S. PATENT DOCUMENTS

| | | | | |
|---|---|---|---|---|
| 6,438,000 | B1 * | 8/2002 | Okamoto et al. | 363/40 |
| 6,618,929 | B2 * | 9/2003 | Kitamura | 29/602.1 |
| 7,009,485 | B2 * | 3/2006 | Tomohiro et al. | 336/200 |
| 7,453,343 | B2 * | 11/2008 | Ito et al. | 336/200 |

FOREIGN PATENT DOCUMENTS

| | | | |
|---|---|---|---|
| JP | 08203737 | | 8/1996 |
| JP | 08-335517 | | 12/1996 |
| JP | 2005012071 | | 1/2005 |
| JP | 2005012072 | | 1/2005 |
| JP | 2005-085997 | | 3/2005 |
| JP | 2006-261585 | | 9/2006 |
| JP | 2006261585 | | 9/2006 |
| JP | 2007027444 | A * | 2/2007 |
| JP | 2008198863 | A * | 8/2008 |

OTHER PUBLICATIONS

Office Action of Apr. 21, 2009 in counterpart JP Application 2007-152323 citing 8-335517; 2005-85997, and 2006-261585 (2 pages).

* cited by examiner

*Primary Examiner*—Tuyen Nguyen
(74) *Attorney, Agent, or Firm*—Young Law Firm, P.C.

(57) ABSTRACT

A common mode choke coil includes two laminated coil conductors, a first magnetic substrate arranged on one of the coil conductors, and a second magnetic substrate arranged on the other coil conductor. When it is assumed that a distance from a conductor center of the one coil conductor to the surface of the first magnetic substrate is designated as A, a distance from a conductor center of the other coil conductor to the surface of the second magnetic substrate is designated as B, and a distance from the conductor center of the one coil conductor to the conductor center of the other coil conductor is designated as C, C<(A+B)/2 is satisfied. Accordingly, because a difference in the distances between the magnetic substrates and the coil conductors becomes relatively small, a leakage inductance due to the difference in the distance decreases, and the cut-off frequency with respect to a differential mode signal can be increased.

5 Claims, 6 Drawing Sheets

COMMON MODE CHOKE COIL

CROSS-REFERENCE TO RELATED APPLICATIONS

This application claims the foreign priority under 35 U.S.C. §119(a)-(d) of Japanese Patent Application No. 2007-152323, filed Jun. 8, 2007, which application is hereby incorporated herein by reference in its entirety.

TECHNICAL FIELD

The present invention relates to a common mode choke coil, and, more specifically relates to a common mode choke coil with a cut-off frequency with respect to a differential mode signal being increased.

BACKGROUND OF THE INVENTION

Recently, as a high-speed signal transmission interface, USB 2.0 standard and IEEE 1394 standard has become prevalent. These interfaces are used in various digital equipment such as personal computers and digital cameras. The USB 2.0 standard and IEEE 1394 standard interfaces adopt a differential signal system in which a pair of data lines is used to transmit a differential signal (differential mode signal), different from a single end transmission system, which has been generally used heretofore.

The differential transmission system has excellent characteristics such that a radiation electromagnetic field generated from the data line is less than that in the single end transmission system and it is hardly affected by exogenous noise. Therefore, it is easy to minimize the amplitude of the signal, and signal transmission can be performed at a higher speed than the single end transmission system by reducing rise time and fall time because of the small amplitude.

FIG. 6 is a circuit diagram of a conventional differential transmission circuit.

The differential transmission circuit shown in FIG. 6 includes a pair of data lines 2 and 4, an output buffer 6 that supplies a differential mode signal to the pair of data lines 2 and 4, and an input buffer 8 that receives the differential mode signal from the pair of data lines 2 and 4. According to such a configuration, an input signal IN to be provided to the output buffer 6 is transmitted to the input buffer 8 via the data lines 2 and 4, and reproduced as an output signal OUT. The differential transmission circuit has such a characteristic that the radiation electromagnetic field generated from the data lines 2 and 4 is less. However, when common noise (common mode noise) is superimposed on the data lines 2 and 4, a relatively large radiation electromagnetic field is generated. In order to reduce the radiation electromagnetic field generated by the common mode noise, as shown in FIG. 6, it is effective to insert a common mode choke coil 10 in the data lines 2 and 4.

The common mode choke coil 10 has such characteristics that an impedance with respect to a differential component (differential mode signal) transmitted on the data lines 2 and 4 is low, and an impedance with respect to an in-phase component (common mode noise) is high. Therefore, by inserting the common mode choke coil 10 in the data lines 2 and 4, the common mode noise transmitted on the pair of data lines 2 and 4 can be intercepted without substantially attenuating the differential mode signal. There has been known a laminated common mode choke coil described in, for example, Japanese Patent Application Laid-open Nos. H8-203737, 2005-12071, and 2005-12072.

The common mode choke coil has the characteristic that the differential mode signal is not attenuated substantially. However, as the frequency becomes high, the attenuation of the differential mode signal gradually increases. Accordingly, to increase the signal quality in the high-speed interface, the cut-off frequency with respect to the differential mode signal needs to be increased further.

SUMMARY OF THE INVENTION

As a result of studies from this point of view, one of the present inventors has found that the cut-off frequency with respect to the differential mode signal can be increased by assigning a predetermined value to a ratio between a width W and a length L of a coil conductor (Japanese Patent Application Laid-open No. 2006-261585). However, as a result of further studies by the present inventors, it has been found that even if the ratio between the width W and the length L of the coil conductor is the same, the cut-off frequency varies depending on the position of the coil conductor in a lamination direction, a thickness of the coil conductor, and a distance between magnetic substrates.

It is therefore an object of the present invention to further increase a cut-off frequency of a common mode choke coil by adjusting the position of a coil conductor in the lamination direction, the thickness of the coil conductor, and the distance between magnetic substrates.

As a result of intensive studies by the present inventors about a relation of the position of the coil conductor in the lamination direction, the thickness of the coil conductor, the distance between the magnetic substrates to the cut-off frequency and the like, it has been found that a decrease of the cut-off frequency is partly due to an unbalance in the distance between the pair of coil conductors and the magnetic substrate.

The present invention has been achieved in view of the above technical knowledge. The common mode choke coil according to the present invention includes first and second laminated coil conductors, a first magnetic substrate arranged on the first coil conductor side, and a second magnetic substrate arranged on the second coil conductor side, and when it is assumed that a distance from a conductor center of the first coil conductor to the surface of the first magnetic substrate is designated as A, a distance from a conductor center of the second coil conductor to the surface of the second magnetic substrate is designated as B, and a distance from the conductor center of the first coil conductor to the conductor center of the second coil conductor is designated as C, an expression of $C<(A+B)/2$ is satisfied.

According to the present invention, because $C<(A+B)/2$ is satisfied, a difference in the distances between the magnetic substrate and the first and second coil conductors becomes relatively small. As a result, because a leakage inductance due to the difference in the distance decreases, the cut-off frequency with respect to the differential mode signal can be increased.

In the present invention, the "conductor center of the coil conductor" indicates a center of the coil conductor in the lamination direction, that is, in the thickness direction.

In the present invention, it is further preferable to satisfy $(A+B)/3<C<(A+B)/2$. According thereto, because the distance between the magnetic substrates is not too far off, the impedance against the common mode noise can be sufficiently ensured.

When the thickness of the first and second coil conductors is designated as E, it is preferable to satisfy $E<(D/3)$. According thereto, the condition of $C<(A+B)/2$ can be easily satisfied without excessively increasing the distance between magnetic substrates or excessively decreasing the distance between coils.

In the present invention, it is also preferable to satisfy A<B/3. According thereto, when these components are sequentially laminated from the first magnetic substrate side, sufficient flatness can be maintained.

In the present invention, it is preferable that a planar shape of the first and second coil conductors be a curved spiral pattern. According thereto, because the conductor length becomes shorter than that of a straight spiral pattern, the cut-off frequency can be further increased.

Thus, according to the present invention, the cut-off frequency of the common mode choke coil can be increased.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
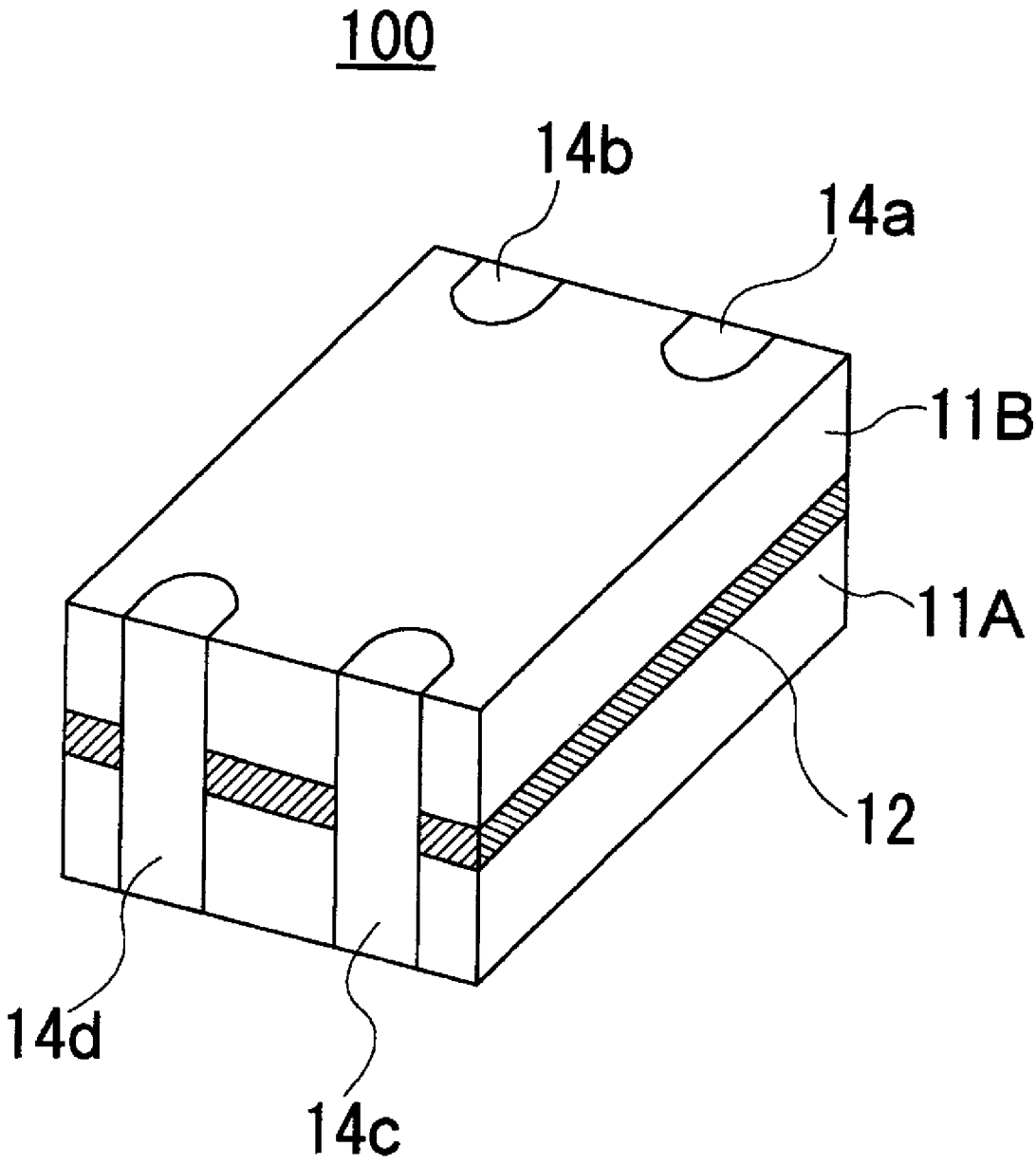
FIG. 1 is a schematic perspective view showing a configuration of a common mode choke coil according to a first embodiment of the present invention.

FIG. 1 is a schematic perspective view showing a configuration of a common mode choke coil 100 according to a first embodiment of the present invention.

As shown in FIG. 1, the common mode choke coil 100 according to the first embodiment is of a thin-film type, and includes first and second magnetic substrates (magnetic layers) 11A and 11B, and a layer structure 12 intervenes between the first and second magnetic substrates 11A and 11B. Terminal electrodes 14*a* to 14*d* are formed on an outer circumference of a laminated body formed of the first magnetic substrate 11A, the layer structure 12, and the second magnetic substrate 11B.

The first and second magnetic substrates 11A and 11B physically protect the layer structure 12 and also have a role as a closed magnetic circuit of the common mode choke coil. As a material of the first and second magnetic substrates 11A and 11B, sintered ferrite, composite ferrite (a resin containing powdered ferrite), or the like can be used.

Figure 2:
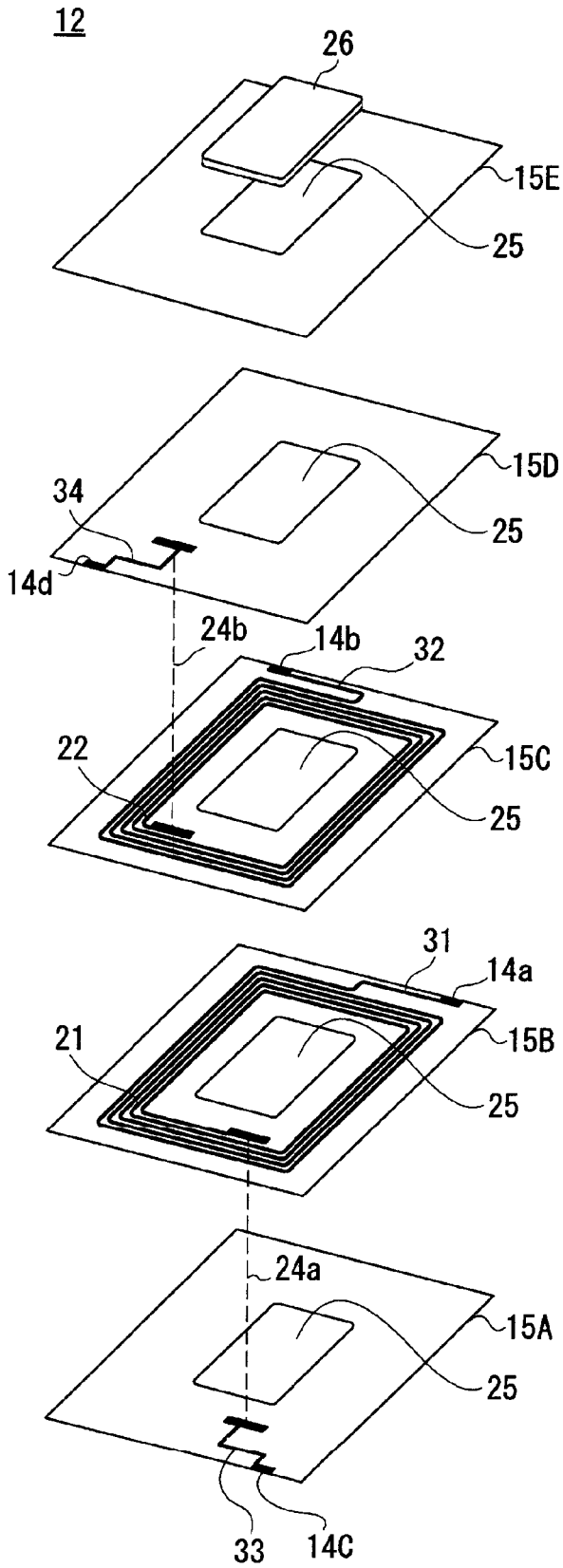
FIG. 2 is a schematic exploded perspective view of the layer structure.

FIG. 2 is a schematic exploded perspective view of the layer structure 12.

As shown in FIG. 2, the layer structure 12 is formed by laminating a plurality of layers according to a thin-film forming technique, and includes first to fifth insulating layers 15A to 15E, first and second coil conductors 21 and 22 that function as an actual common mode choke coil, and first to fourth extraction conductors 31 to 34. The layer structure 12 in the first embodiment has a four-layer structured conductive layer provided between the first insulating layer 15A to the fifth insulating layer 15E.

The first to fifth insulating layers 15A to 15E insulate between respective conductor patters, or between the conductor pattern and the magnetic substrate, and also play a role of ensuring the flatness of a plane on which the conductor pattern is formed. Particularly, the first and fifth insulating layers 15A and 15E alleviate surface roughness of the first and second magnetic substrates 11A and 11B, to increase adhesiveness of the conductor pattern. Although not particularly limited, it is preferable to use resin materials having excellent electrical and magnetic insulating properties and good processability such as polyimide resin and epoxy resin, for the insulating layers 15A to 15E.

An opening 25 penetrating the first to fifth insulating layers 15A to 15E is provided in an inside central region of the first and second coil conductors 21 and 22. A magnetic body 26 for forming the closed magnetic circuit between the first magnetic substrate 11A and the second magnetic substrate 11B is provided inside the opening 25. A magnetic material such as composite ferrite can be used for the magnetic body 26.

The first coil conductor 21 is provided on the second insulating layer 15B. The first coil conductor 21 is made of a metal material such as Cu, and has a spiral shape. An end on the outer circumference side of the first coil conductor 21 is connected to the terminal electrode 14*a* via the first extraction conductor 31. On the other hand, an end on the inner circumference side of the first coil conductor 21 is connected to the terminal electrode 14*c* via a contact hole 24*a* penetrating the second insulating layer 15B and the third extraction conductor 33.

The second coil conductor 22 is provided on the third insulating layer 15C. The second coil conductor 22 is also made of a metal material such as Cu, and has the same spiral shape as that of the first coil conductor 21. Because the second coil conductor 22 is provided at the same position as the first coil conductor 21 as seen in a plan view, and completely overlapped on the first coil conductor 21, strong magnetic coupling occurs between the first and second coil conductors 21 and 22. An end on the outer circumference side of the second coil conductor 22 is connected to the terminal electrode 14*b* via the second extraction conductor 32. On the other hand, an end on the inner circumference side of the second coil conductor 22 is connected to the terminal electrode 14*d* via a contact hole 24*b* penetrating the fourth insulating layer 15D and the fourth extraction conductor 34.

The thickness of the first coil conductor 21 and the thickness of the second coil conductor 22 are substantially the same. As described later, the thickness of the coil conductors is an important parameter, which affects the cut-off frequency.

Figure 3:
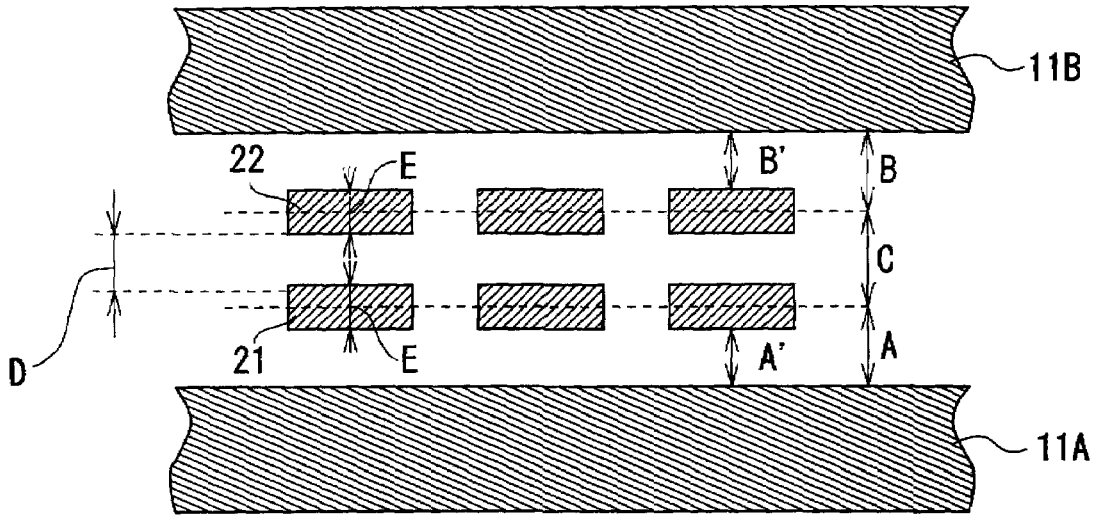
FIG. 3 is a partial sectional view of the common mode choke coil according to the first embodiment of the present invention.

FIG. 3 is a partial sectional view of the common mode choke coil 100 according to the first embodiment.

As shown in FIG. 3, when it is assumed that a distance from the conductor center of the first coil conductor 21 to the surface of the first magnetic substrate 11A is designated as A, a distance from the conductor center of the second coil conductor 22 to the surface of the second magnetic substrate 11B is designated as B, and a distance from the conductor center of the first coil conductor 21 to the conductor center of the second coil conductor 22 is designated as C, the common mode choke coil 100 according to the first embodiment satisfies C<(A+B)/2. The distance A corresponds to a sum of a total thickness of the first and second insulating layers 15A and 15B shown in FIG. 2 (=A') and half the thickness of the coil conductor (=E/2). The distance B corresponds to a sum of a total thickness of the fourth and the fifth insulating layers 15D and 15E (=B') and half the thickness of the coil conductor (=E/2). Further, the distance C corresponds to a sum of the thickness of the third insulating layer 15C (=D) and the thickness of the coil conductor (=E).

Satisfying the above relational expression means that a difference in the distances between the first magnetic substrate 11A and the first and second coil conductors 21 and 22, and a difference in the distances between the second magnetic substrate 11B and the first and second coil conductors 21 and 22 are small. Accordingly, the leakage inductance due to the difference in the distance decreases, and the cut-off frequency with respect to the differential mode signal can be increased.

The difference in the distance between the magnetic substrates and the first and second coil conductors 21 and 22 is explained in detail. As shown in FIG. 3, because the first coil conductor 21 and the second coil conductor 22 are laminated, the distances from one magnetic substrate to the first and second coil conductors 21 and 22 are certainly different. That is, as seen from the first magnetic substrate 11A, whereas the distance to the first coil conductor 21 is A, the distance to the second coil conductor 22 is A+C, and the second coil conductor 22 is always on the far side. On the contrary, as seen from the second magnetic substrate 11B, whereas the distance to the second coil conductor 22 is B, the distance to the first coil conductor 21 is B+C, and the first coil conductor 21 is always on the far side.

The unbalance occurring inevitably increases the leakage inductance, to thereby cause a decrease in the cut-off frequency. In the present invention, therefore, the distances A and B are set large and the distance C is set small, to thereby satisfy the expression $C<(A+B)/2$. Accordingly, because the unbalance decreases, the leakage inductance can be decreased.

However, if distances A and B are set too large, the distance between the magnetic substrates 11A and 11B becomes too large, and as a result, the impedance against the common mode noise decreases. If this point is taken into consideration, it is further preferable to satisfy $(A+B)/3<C<(A+B)/2$. According thereto, because the distance between the magnetic substrates 11A and 11B is not too far off, the impedance against the common mode noise can be sufficiently ensured. An allowable distance between the magnetic substrates 11A and 11B depends on the cut-off frequency required.

On the other hand, if the distance between coils (the distance from the surface of the first coil conductor 21 to the surface of the second coil conductor 22) D is set too narrow in order to decrease the distance C, a characteristic impedance largely varies, and hence, a desired characteristic cannot be obtained.

Further, because the distance between coils D is approximately fixed according to the required characteristic, there is little room for actually adjusting the distance D. Therefore, to decrease the distance C without changing the distance D, the thickness E of the coil conductors needs only to be set small, while fixing the distance D. Specifically, it is preferable to satisfy $E<(D/3)$. According thereto, the condition of $C<(A+B)/2$ can be easily satisfied without excessively increasing the distance between the magnetic substrates or excessively decreasing the distance between the coils.

Although the relation between the distance A and the distance B is not particularly limited, when the components are sequentially laminated from the first magnetic substrate 11A side at the time of manufacture, it is preferable to satisfy a condition of $A<B/3$. This is because, if the distance A is increased at the time of laminating from the first magnetic substrate 11A, the first and second insulating layers 15A and 15B need to be set thick, and as a result, the flatness decreases at the time of lamination, to thereby deteriorate the characteristic. On the other hand, if the distances are set to be $A<B/3$, the thickness of the first and second insulating layers 15A and 15B, which are on a lamination starting side, can be set sufficiently thin, and hence, sufficient flatness can be maintained.

As explained above, because the common mode choke coil according to the first embodiment satisfies $C<(A+B)/2$, the unbalance in the distance between the magnetic substrate and the first and second coil conductors 21 and 22 is small. Accordingly, the leakage inductance decreases, and the cut-off frequency with respect to the differential mode signal can be increased.

Figure 4:
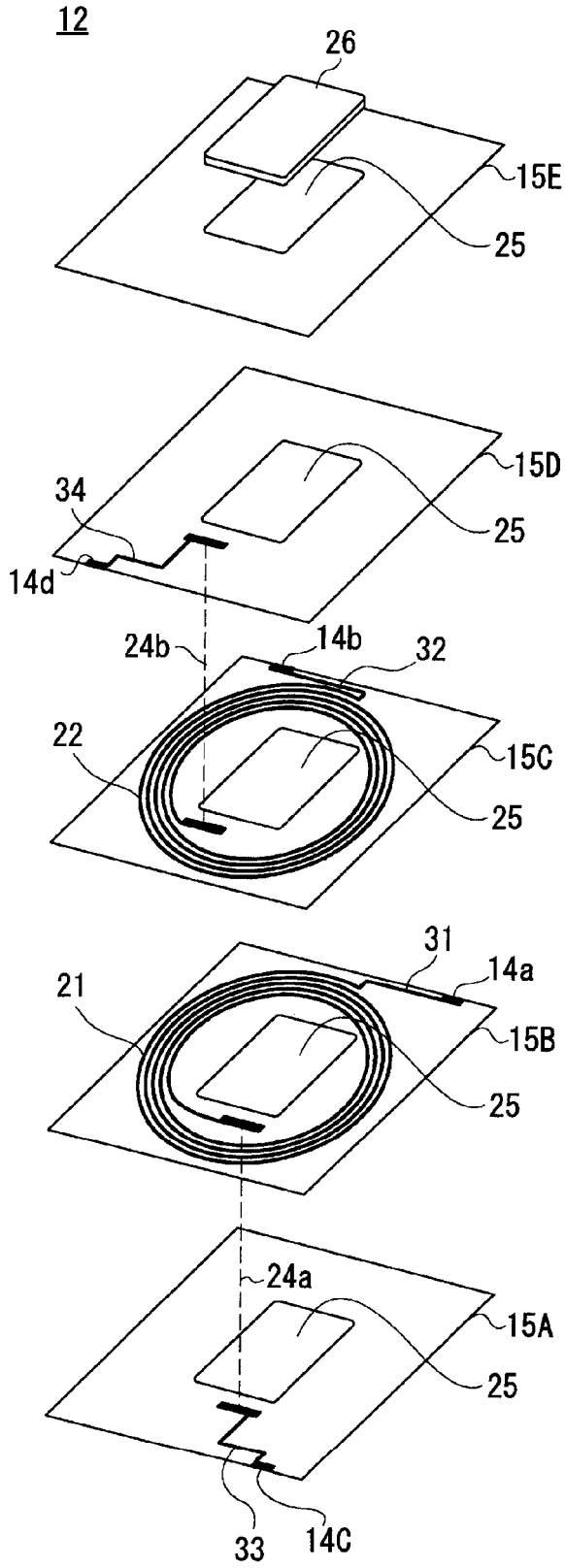
FIG. 4 is a schematic exploded perspective view of the layer structure included in a common mode choke coil according to a second embodiment of the present invention.

FIG. 4 is a schematic exploded perspective view of the layer structure 12 included in a common mode choke coil 200 according to a second embodiment of the present invention.

As shown in FIG. 4, in the second embodiment, a planar shape of the first and second coil conductors 21 and 22 has a curved spiral pattern. That is, in the first embodiment, the planar shape of the first and second coil conductors 21 and 22 is approximately square and has a linear spiral pattern, while in the second embodiment, the planar shape of the first and second coil conductors 21 and 22 is approximately circular.

According to such a planar shape, the conductor length of the first and second coil conductors 21 and 22 can be made shorter than that in the first embodiment. As a result, the cut-off frequency with respect to the differential mode signal can be further increased.

The present invention is in no way limited to the aforementioned embodiments, but rather various modifications are possible within the scope of the invention as recited in the claims, and naturally these modifications are included within the scope of the invention.

EXAMPLE

An Example of the present invention is explained below; however, the present invention is by no way limited to the example.

First, a common mode choke coil of working Example and a common mode choke coil of Comparative example having the same configuration as that of the common mode choke coil 100 shown in FIGS. 1 to 3 were prepared. In each sample, the distance A' from the surface of the first magnetic substrate 11A to the surface of the first coil conductor 21 was set to 10 μm, the distance B' from the surface of the second magnetic substrate 11B to the surface of the second coil conductor 22 was set to 38 μm, and the distance between coils D was fixed to 20 μm. For the Example, a thickness E of the coil conductor was set to 5 μm, while the thickness E of the coil conductor was set to 18 μm for the Comparative example. That is, only the thickness E of the coil conductor was different between the Example and the Comparative example.

Accordingly, the distances A to C shown in FIG. 3 were as shown in Table 1.

TABLE 1

| | A (μm) | B (μm) | C (μm) |
|---|---|---|---|
| EXAMPLE | 12.5 | 40.5 | 25.0 |
| COMPARATIVE EXAMPLE | 19.0 | 47.0 | 38.0 |

As shown in Table 1, in the Example, $C<(A+B)/2$ was satisfied, whereas in the Comparative example, $C \geqq (A+B)/2$.

The common mode choke coils in the Example and the Comparative example were then respectively connected to a measuring instrument, to measure the frequency characteristic of each sample with respect to the differential mode signal. The measurement results are shown in FIG. 5.

Figure 5:
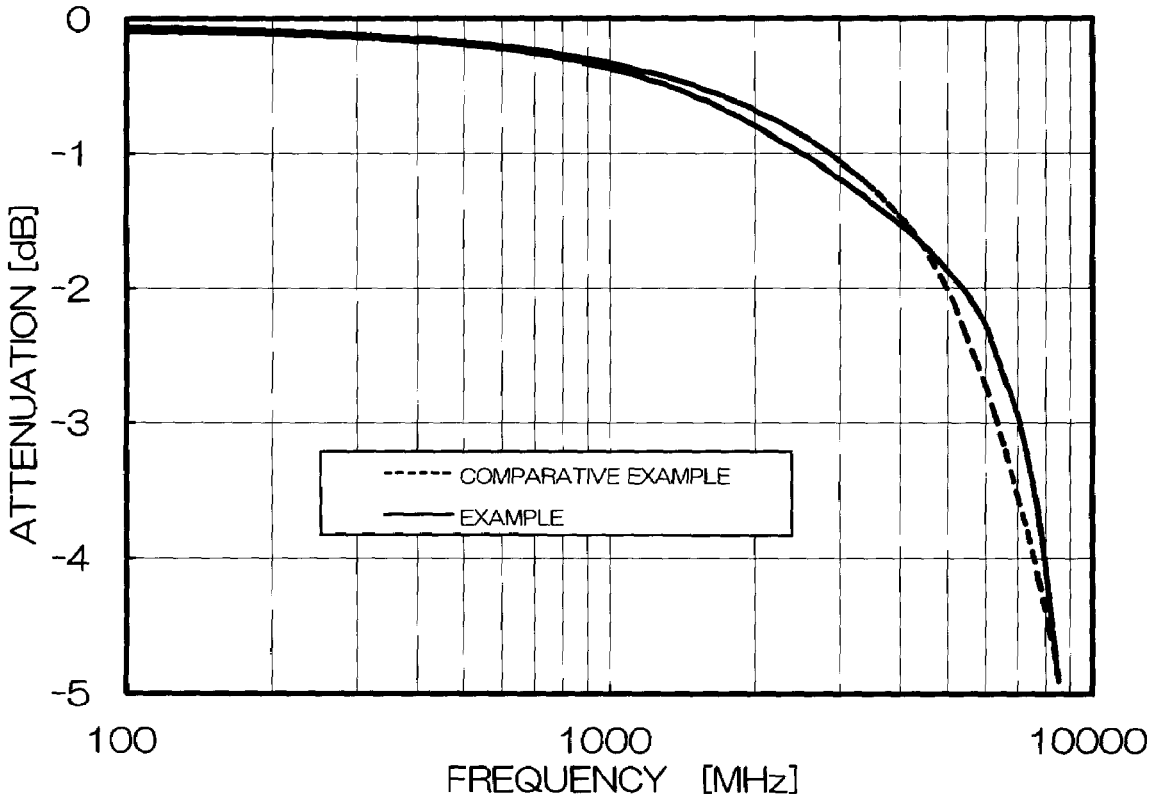
FIG. 5 is a graph showing a frequency characteristic of an insertion loss with respect to a differential mode signal.
Figure 6:
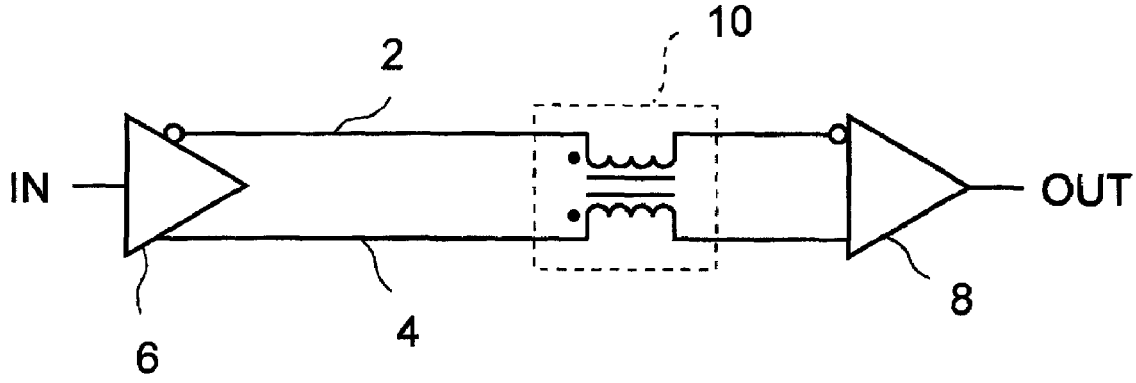
FIG. 6 is a circuit diagram of a conventional differential transmission circuit.

As shown in FIG. 5, a cut-off frequency fc (frequency attenuated by 3 dB) was 6.3 GHz in the Comparative example sample, whereas in the Example sample, it was 7.1 GHz. That is, it was confirmed that in the Example satisfying $C<(A+B)/2$, the cut-off frequency fc was higher by about 0.8 GHz than in the Comparative example.

What is claimed is:

1. A common mode choke coil comprising:

first and second laminated coil conductors;

a first magnetic substrate arranged on the first coil conductor side; and a second magnetic substrate arranged on the second coil conductor side, wherein $C<(A+B)/2$ is satisfied where a distance from a conductor center of the first coil conductor to a surface of the first magnetic substrate is designated as A, a distance from a conductor center of the second coil conductor to a surface of the second magnetic substrate is designated as B, and a distance from the conductor center of the first coil conductor to the conductor center of the second coil conductor is designated as C.

2. The common mode choke coil as claimed in claim 1, wherein $(A+B)/3<C<(A+B)/2$ is satisfied.

3. The common mode choke coil as claimed in claim 1, wherein $E<(D/3)$ is satisfied where a thickness of the first and second coil conductors is designated as E.

4. The common mode choke coil as claimed in claim 1, wherein $A<B/3$ is satisfied.

5. The common mode choke coil as claimed in claim 1, wherein a planar shape of the first and second coil conductors is a curved spiral pattern.

* * * * *